United States Patent [19]

Turek

[11] 4,323,227

[45] Apr. 6, 1982

[54] CONNECTOR FIXTURE

[75] Inventor: James A. Turek, LaGrange, Ill.

[73] Assignee: Panduit Corp., Tinley Park, Ill.

[21] Appl. No.: 123,583

[22] Filed: Feb. 22, 1980

[51] Int. Cl.[3] ..... B25B 1/00

[52] U.S. Cl. ..... 269/254 R; 269/903

[58] Field of Search ..... 269/903, 254 R, 287, 269/37, 152; 29/281.1, 749, 760; 248/74 A, 74 R, 316 D, 67.5, 37.3, 37.6

[56] References Cited

U.S. PATENT DOCUMENTS

| | | | |
|---|---|---|---|
| 148,901 | 3/1874 | Smith | 269/254 R |
| 2,632,619 | 3/1953 | Wilson | 248/316 D |
| 2,773,303 | 12/1956 | Tirone | 269/152 |
| 3,859,728 | 1/1975 | Folkenroth | 29/760 |
| 3,884,438 | 5/1975 | Longsdon | 248/74 R |
| 3,946,768 | 3/1976 | Fiorentino | 29/760 |
| 4,126,304 | 11/1978 | Barck | 269/903 |
| 4,175,728 | 11/1979 | Ferguson | 269/254 R |
| 4,211,395 | 7/1980 | Edwards et al. | 269/254 R |

*Primary Examiner*—Robert C. Watson

*Attorney, Agent, or Firm*—Charles R. Wentzel; Richard B. Wakely

[57] ABSTRACT

A fixture for holding a mass termination connector, of the type adapted to firmly retain conductors prior to their electrical termination in the connector, as the conductors are laid out and positioned to be firmly retained. The fixture includes a base for mounting on a wiring board and a channel-shaped holder joined to the base for holding the connector. The holder is disposed tilted with respect to the base so that the insulation displacement terminal plates of the connector are inclined whereby movement of a tensioned conductor extending between two connectors is resisted by corresponding inclined plates indenting the insulation of the conductor.

8 Claims, 8 Drawing Figures

CONNECTOR FIXTURE

BACKGROUND OF THE INVENTION

The present invention relates to fixtures for holding articles and more particularly to a wiring board fixture for mounting a mass termination connector.

Mass termination connectors, which function to electrically terminate by insulation displacement a plurality of conductors in response to a single stroke of an insertion tool, are coming into increasing commercial prominence because of their tremendous reduction in tedious iterative manual operations in comparison with the previous wiring method of stripping the insulation from each conductor, placing a terminal on each stripped end and crimping the respective terminals on the respective conductors. One such mass termination connector, which is fully disclosed in commonly assigned U.S. patent application Ser. No. 909,732, filed May 25, 1978, now U.S. Pat. No. 4,191,442, includes a housing having front and back walls and a plurality of spaced, electrically isolated metallic contact elements disposed intermediate the walls.

Each element includes a slotted vertical plate for electrically terminating a conductor. Before termination, however, these plates cooperate with retention ears carried by the front and back walls to firmly hold the conductors by bending the conductors from their as-manufactured axial direction. This premits a harness to be completed except for termination at one location and then to be moved to a remote location for termination.

Prior art wiring board fixtures are poorly suited for such a connector which permits movement of the harness prior to termination. These fixtures are for use with connectors in which wiring lay out and termination had to be completed at the same station. Such fixtures, which are of multipiece metal construction, are quite expensive and are required to support and react against the insertion tool which generates high forces. Additionally, they carry wire separation combs and conductor cutter bars. Furthermore, mounting of the connector requires manual tightening of a bolt to compress the connector. Reference may be made to U.S. Pat. No. 3,859,724.

SUMMARY OF THE INVENTION

Among the several objects of the present invention may be noted the provision of an improved fixture for a mass termination connector; the provision of such a fixture which permits fast and convenient mounting and dismounting of the connector; the provision of such a fixture which aids the user by indicating the various contact elements of the connector and prevents substantial sideways movement of the mounted connector; and the provision of such a tool which is light in weight, has long service life and is simple and economical to manufacture. Other objects and features of the present invention will be in part apparent and in part pointed out hereinafter in the specification and in the claims.

Briefly, the fixture of the present invention includes a mounting base for attachment to a wiring board and further comprises a channel-shaped holder joined to the base for holding a mass termination connector. The holder is disposed tilted with respect to the base so that the insulating displacement plates of the connector are inclined whereby movement of a tensioned conductor extending between two connectors is resisted by corresponding inclined plates indenting the insulation of the conductor.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
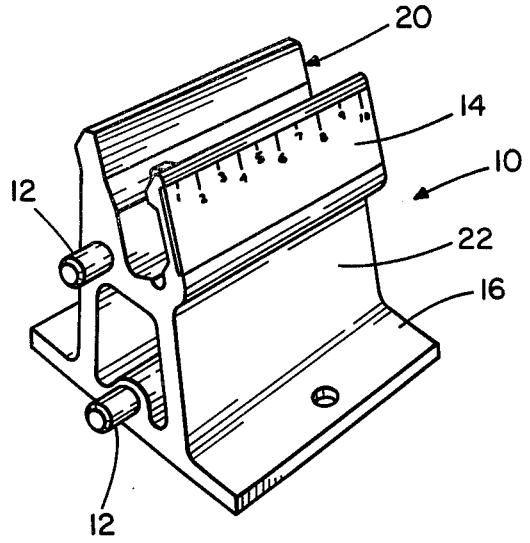
FIG. 1 is a perspective view of a fixture of the present invention for holding a mass termination connector.
Figure 2:
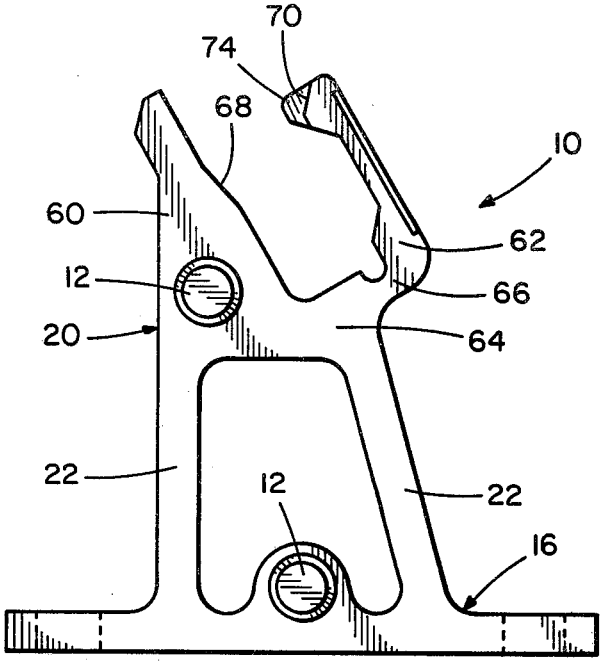
FIG. 2 is a side elevational view of the fixture of FIG. 1.

Referring now to the drawings, a fixture, for mounting a mass termination connector 26 (best shown in FIGS. 5–8), is generally indicated in FIG. 1 by reference numeral 10. Except for indicia plate 14, which will be described more fully hereinafter, fixture 10 is of one-piece molded thermoplastic construction. As best shown in FIG. 2, fixture 10 comprises a base 16 adapted for attachment to a wiring board 18 or the like, and a channel shaped holder 20 for receiving connector 26. The holder and base are connected by a pair of legs 22 to elevate the connector with respect to the wiring board to provide the assembler with additional working space to wire the connector.

A mass termination connector similar to connector 26, best shown in FIGS. 5–8, is fully illustrated and described in commonly-assigned U.S. patent application Ser. No. 909,732, filed May 25, 1978. The connector comprises a housing 30 including a front wall 32, a back wall 34, and a plurality of regularly spaced barrier walls 36 which together define an array of cavities 38. Positioned in each cavity is a metallic terminal element 40 including a self-stripping wire-receiving portion 42. The wire-receiving portion includes a pair of substantially vertically disposed spaced slotted plates 44 each having an entrance 46 for guiding a wire into the slot. The plates 44 extend generally parallel to front wall 32 and back wall 34. It will be appreciated that a conductor positioned over the entrances and moved laterally of its axial direction into the slots will have its insulation removed by the plate sections defining the slots resulting in electrical termination of the conductor in the terminal element. The front and rear walls each have a series of aligned openings 48 and 50, respectively, extending from a wire-receiving face 52 of the connector housing for permitting access of the various conductors to their corresponding terminal elements. Front wall 32 also includes a series of spaced vertical ribs 72.

Housing 30 comprises first conductor retention means disposed on the side of plates 44 remote from back wall 34 and second conductor retention means disposed on the side of plates 44 remote from front wall 32. More specifically, front wall 32 includes sets of opposed resilient ears 54 (which constitute the first retention means) extending into each front wall opening 48 to define a constricted throat to the opening. Similarly rear wall 50 comprises sets of opposed resilient ears 56 (which constitute the second retention means) extending into each rear wall opening 50 to define a constricted throat to a back wall opening. Respective sets of ears 54 and 56 as well as portions of plates 44 defining entrances 46 cooperate to deflect a conductor out of its as-manufactured axial direction and constitute means for mechanically holding each conductor in alignment with a respective cavity prior to termination of the conductor.

It should be noted that front wall ears 54 are disposed at a lower height with respect to plates 44 than are rear wall ears 56. After the conductors are terminated in the slotted plates and the excess portions of the conductors severed adjacent back wall 34, the lower front wall ears serve as a strain relief to resist conductor pull out from the slotted plates 44.

Figure 3:
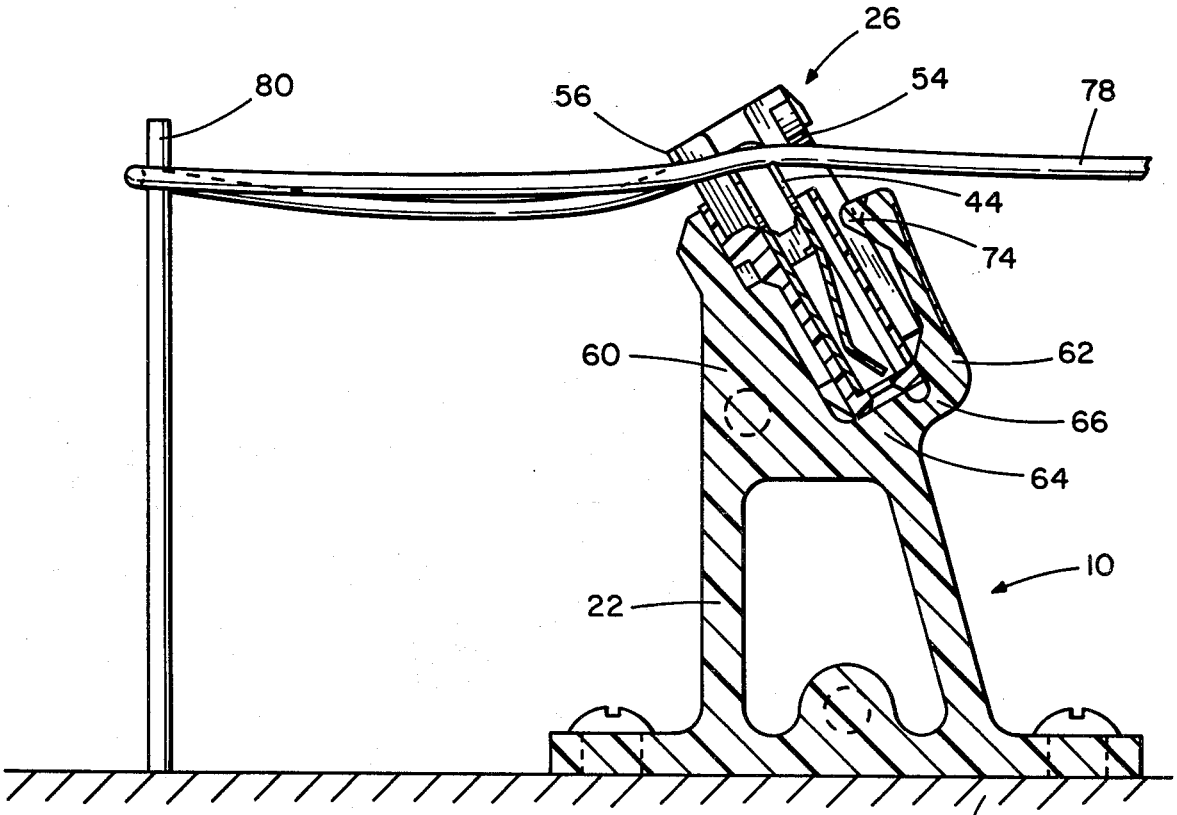
FIG. 3 illustrates the fixture of FIG. 1 attached to a wiring board and mounting a connector during wiring of the connector.
Figure 7:
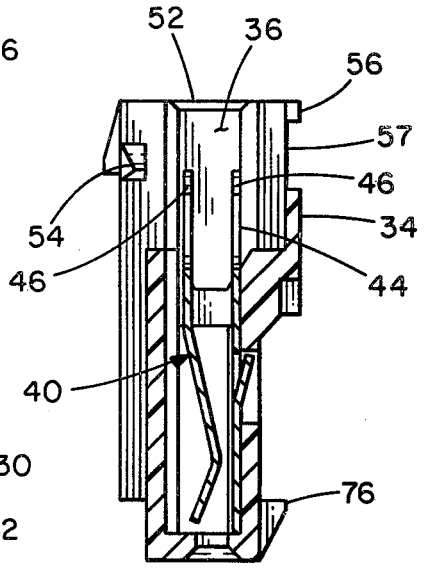
Figure 8:
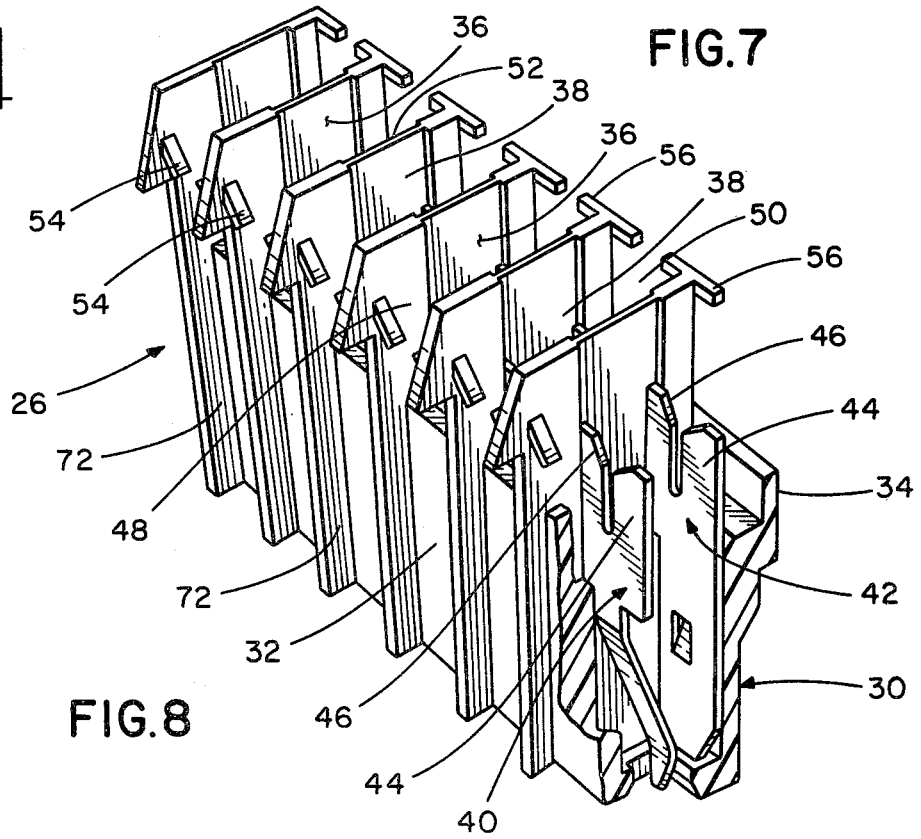
FIG. 8 is a perspective view of the connector with certain components removed to expose one of the terminal elements held by the connector housing.

Referring to FIGS. 1–3, holder 20, which holds connector 26 in an interference fit, comprises a relatively rigid back support 60, a resilient front arm 62 and a web 64 joining the back support and the front arm. Web 64 includes an area of reduced cross section 66 adjacent the front arm to reduce the force required to deflect the front arm during mounting of the connector. Back support 60 and front arm 62 include respective cam surfaces 68, 70 to assist in the deflection of the front arm. The back support and lower portion of front arm 62, which engages the lower portion of housing front wall 32, cooperate to rigidly hold the connector to permit the assembler to move the conductor downwardly past retention ears 54 and 56. The outside surface of front arm 64 carries indicia plate 14 which identifies the various terminal elements of the connector while an inwardly directed tooth 74 extending from arm 62, sized to fit between adjacent front wall ribs 72, prevents substantial sideways movement of the mounted connector to maintain the terminal elements in alignment with their corresponding plate markings. Tooth 74, however, does interfere with lugs 76 positioned on the lower portion of the housing back wall, as shown in FIG. 7, to preclude inadvertent reverse mounting of connector 26.

Figure 6:
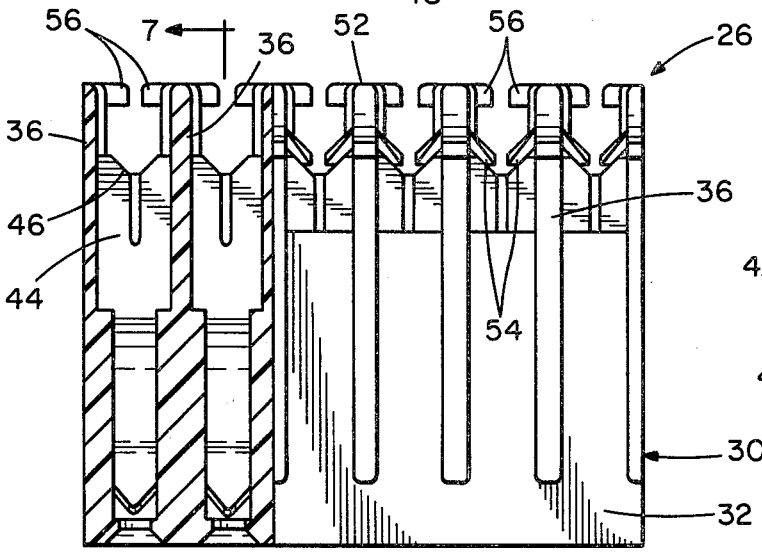

As best shown in FIGS. 1 and 2, interconnection pins 12 extend from one side of fixture 10 while the other side of the fixture includes apertures, in registration with the pins, for receiving the pins of another fixture to interconnect the fixtures in ganged relationship. Referring to FIG. 6, the exterior connector housing barrier walls have a thickness of only one-half that of interior barrier walls 36 which allows, for example, an eight element connector and a twelve element connector to be mounted in two ganged fixtures with the plate indicia accurately identifying the respective terminal elements.

Referring to FIG. 3, holder 20 is tilted approximately thirty degrees with respect to base 16. When the connector 26 is mounted in the tilted holder, front wall ears 54 and rear wall ears 56 are disposed at substantially the same level with respect to the terminal element plate 44 which cooperates with the ears to hold a conductor 78 prior to its electrical termination. This permits the assembler to more easily move the conductor to be held beneath the level of the ears and avoids unnecessary bending of the conductor. Another advantage of tilting the connector is that when a tensioned conductor is held between two outwardly tilted connectors, inclined plates 44 tend to indent the conductor insulation to further aid in preventing loosening of the conductor.

Figure 4:
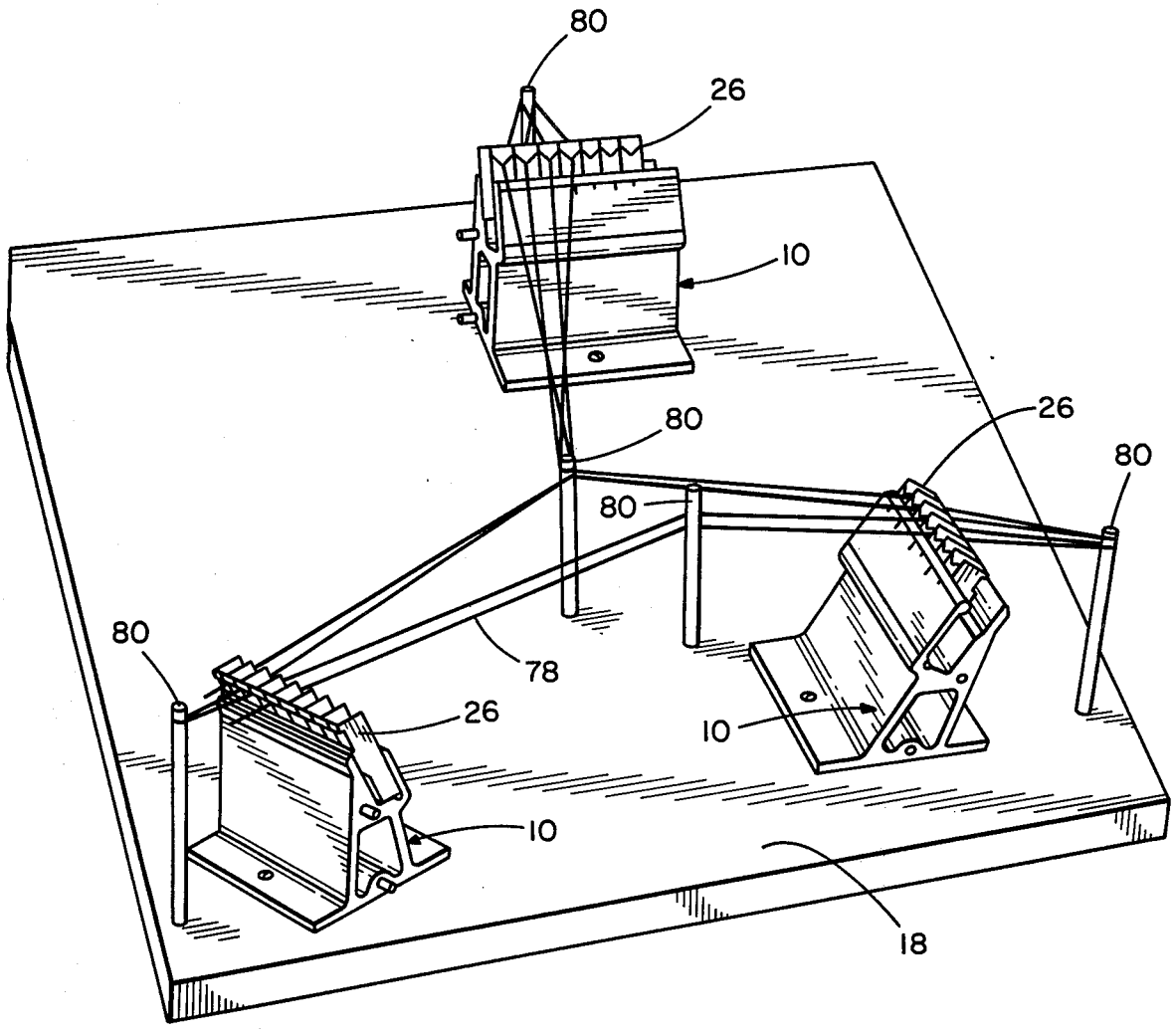
FIG. 4 is a perspective view of a wiring board on which several fixtures are positioned illustrating the fabrication of a simple harness.
Figure 5:
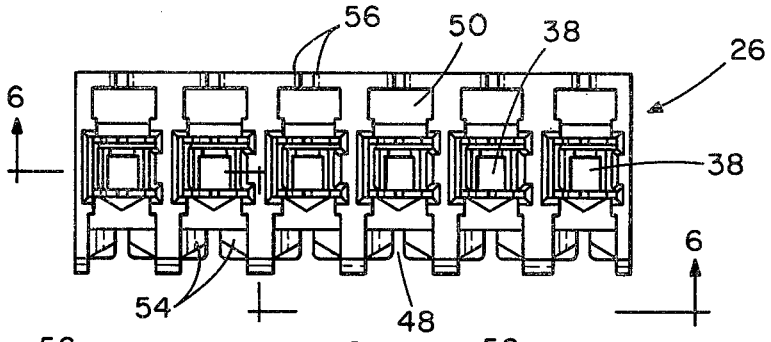
FIGS. 5, 6 and 7 are, respectively, plan, front and side elevational views of the connector of FIG. 3.

Operation of the fixture 10 of the present invention is as follows. The fixtures 10 are attached to wiring board 18 at the desired ends of the harness to be fabricated, as shown in FIG. 4. Dowels or pins 80 are positioned to define the intermediate route of the conductors and additionally are positioned behind the fixtures to serve as conductor turnarounds when a single conductor is used for multiple runs. Connectors 26 are then simply slid into the tilted holders and wiring is completed according to the requirements of the harness. For a simple harness such as shown in FIG. 4, the harness, completed except for termination, can be removed from wiring board 18 by simply grasping the central portion of the harness and applying a vertical pull. This causes the fixture front arms 62 to deflect sufficiently for all connectors 26 to be concurrently released without disassociation of any conductor from its corresponding terminal element 42. In marked contrast to prior art connector fixtures, connectors can be loaded into fixtures 10 in a single motion and release of wired connectors can be achieved without the assembler even touching the fixture.

After the harness is removed from wiring board 18, the harness can be moved to a termination station where termination is effected using a suitable termination press or a portable termination tool such as the one fully illustrated and described in commonly assigned U.S. patent application Ser. No. 045,578, filed June 4, 1979, now U.S. Pat. No. 4,242,792.

In view of the above, it will be seen that the several objects of the invention are achieved and other advantageous results attained.

As various changes could be made in the above constructions without departing from the scope of the invention, it is intended that all matter contained in the above description shall be interpreted as illustrative and not in a limiting sense.

What is claimed is:

1. The combination of a fixture for holding a mass termination connector and said connector; said connector including a housing having a front wall and a back wall and further including a series of regularly spaced metal contact elements disposed intermediate said walls each of which comprises a substantially vertically disposed slotted plate extending generally parallel to said walls for displacing insulation of a conductor corresponding to said plate thereby to electrically terminate said conductor, said housing including first retention means disposed on the side of said plates remote from said back wall and second retention means disposed on the side of said plates remote from said front wall, said first and second retention means and said plates firmly retaining conductors prior to their termination by holding said conductors bent from their as-manufactured axial direction; said fixture comprising:

a base for mounting on a wiring board or the like; and a channel-shaped holder joined to said base for holding said connector, said holder disposed tilted with respect to said base so that said plates are inclined relative to said wiring board whereby movement of a tensioned conductor extending between two connectors is resisted by corresponding inclined plates indenting the insulation of said conductor, said holder comprising a relatively rigid back support and a resilient front arm joined by a web, said front arm and back support holding said connector in an interference fit, said connector front wall including a plurality of spaced vertical ribs, said holder front arm carrying an inwardly directed tooth sized to fit between adjacent ribs to preclude substantial sideways movement of the mounted connector.

2. The combination as set forth in claim 1 wherein said first and second retention means are disposed at different heights with respect to the top edges of said plates prior to placement of said connector in said fixture, said holder being tilted to the degree that, with the connector mounted in the fixture, said first and second retention means are disposed at substantially the same level with respect to the top edges of said plates.

3. The combination as set forth in claim 1 wherein said holder is tilted substantially thirty degrees relative to said base.

4. The combination as set forth in claim 1 further comprising at least one leg interconnecting said base and holder to elevate said connector with respect to said wiring board.

5. The combination as set forth in claim 1 further comprising at least one interconnection pin extending from one side of said fixture, the other side of said fixture having an aperture in registration with said pin for receiving the pin of another fixture whereby said fixtures can be interconnected in ganged relationship.

6. The combination as set forth in claim 1 wherein said web includes an area of reduced cross section adjacent said front arm to reduce the force required to deflect the front arm during mounting of the connector.

7. The combination as set forth in claim 1 wherein the outside surface of said front arm carries indicia which identifies the various terminal elements of said connector.

8. The combination of a fixture for holding a mass termination connector and said connector; said connector including a housing having a front wall and a back wall and further including a series of regularly spaced metal contact elements disposed intermediate said walls each of which comprises a substantially vertically disposed slotted plate extending generally parallel to said walls for displacing insulation of a conductor corresponding to said plate thereby to electrically terminate said conductor, said housing including first retention means disposed on the side of said plates remote from said back wall and second retention means disposed on the side of said plates remote from said front wall, said first and second retention means and said plates firmly retaining conductors prior to their termination by holding said conductors bent from their as-manufactured axial direction; said fixture comprising:

a base for mounting on a wiring board or the like; and a channel-shaped holder joined to said base for holding said connector, said holder disposed tilted with respect to said base so that said plates are inclined relative to said wiring board whereby movement of a tensioned conductor extending between two connectors is resisted by corresponding inclined plates indenting the insulation of said conductor, said fixture further comprising at least one interconnection pin extending from one side of said fixture, the other side of said fixture having an aperture in registration with said pin for receiving the pin of another fixture whereby said fixtures can be interconnected in ganged relationship.

* * * * *